US006006359A

United States Patent [19]

Lazarus

[11] Patent Number: 6,006,359

[45] **Date of Patent: *Dec. 28, 1999**

[54] SPORTS GLOVE WITH ASYMMETRICAL FINGER SEAM PATTERN

[75] Inventor: Alan H. Lazarus, Cincinnati, Ohio

[73] Assignee: Boyce-Lazarus Corporation, Cincinnati, Ohio

[ * ] Notice: This patent is subject to a terminal disclaimer.

[21] Appl. No.: 09/217,666

[22] Filed: Dec. 21, 1998

Related U.S. Application Data

[63] Continuation-in-part of application No. 08/919,645, Aug. 28, 1997, Pat. No. 5,850,635, which is a continuation-in-part of application No. 08/650,300, May 13, 1996, Pat. No. 5,682,614, which is a continuation-in-part of application No. 08/236,119, May 2, 1994, Pat. No. 5,515,548.

[51] Int. Cl.[6] ..... A41D 19/00

[52] U.S. Cl. ..... 2/169

[58] Field of Search ..... 2/161.2, 161.1, 2/159, 163, 169; 112/418

[56] References Cited

U.S. PATENT DOCUMENTS

| | | | |
|---|---|---|---|
| 144,665 | 11/1873 | Foster | 2/169 |
| 174,764 | 3/1876 | Blanchard | 112/418 |
| 666,853 | 1/1901 | Morgan | 2/169 |
| 692,224 | 2/1902 | Baird | 2/169 |
| 956,156 | 4/1910 | Ornas | 2/169 |
| 975,289 | 11/1910 | Sachs | 2/169 |
| 1,220,524 | 3/1917 | McNeil | 112/418 |
| 1,252,900 | 1/1918 | Grinnell | 2/169 |
| 2,439,700 | 4/1948 | Simon | 112/418 |
| 3,151,334 | 10/1964 | Haupt et al. | 2/169 |
| 4,858,245 | 8/1989 | Sullivan et al. | 2/169 |
| 5,175,886 | 1/1993 | Suk | 2/161.2 |

*Primary Examiner*—Michael A. Neas
*Attorney, Agent, or Firm*—John M. Brandt

[57] ABSTRACT

A sport glove finger construction utilizing an asymmetrical pattern resulting in a seam which lies above the tip and on the back of the fingernail of the user.

6 Claims, 3 Drawing Sheets

SPORTS GLOVE WITH ASYMMETRICAL FINGER SEAM PATTERN

CROSS REFERENCE TO RELATED APPLICATIONS

This application is a continuation-in-part of application Ser. No. 08/919,645 filed Aug. 28, 1997, now U.S. Pat. No. 5,850,635, which is a continuation-in-part of application Ser. No. 08/650,300 filed May 13, 1996, now U.S. Pat. No. 5,682,614, which is a continuation-in-part of application Ser. No. 08/236,119 filed May 2, 1994, now U.S. Pat. No. 5,515,548.

BACKGROUND OF THE INVENTION

1. Field of Invention

The invention resides in the field of sports gloves and more particularly relates to an improvement in a glove with an asymmetrical finger seam pattern.

2. Description of Prior Art

The aforementioned patents contain a detailed disclosure of an asymmetrical patterned thumb for a sports glove. In those patents, the asymmetrical pattern (the palm and back portions being of completely different shapes) consists of a central palm portion and two opposed wing portions attached thereto. The purpose of this arrangement is to provide a finished thumb wherein the thumb seam is positioned over the back of the thumbnail rather than the tip and sides as in the case in conventional gloves.

In the pattern, The palm portion is the shape of a full thumb including the sides, and the wing portions are each the shape of a half of a back of a thumb and are sized such that when folded over and joined to each other with a central lateral seam and joined to the palm portion by a cross seam, the relocation of the thumb seam to the back of the thumbnail is achieved.

The present invention by the same inventor applies the previously disclosed asymmetrical pattern concept to the construction of a glove finger.

SUMMARY OF THE INVENTION

The invention may be summarized as an improvement in a sports glove, in which the finger seam is positioned over the back of the fingernail rather than the tip and side of the finger as in the present case with conventional gloves. This is accomplished utilizing a finger pattern which is asymmetrical rather than symmetrical having a central palm portion and two opposed wing portions attached thereto.

The use of inseams is a preferred method of construction as disclosed in the applicant's above cited patents which are hereby incorporated by reference. As is similar to that described therein in the present invention. The palm portion is the shape of the full finger including the sides, and the wing portions are each the shape of half of a back of a finger and are sized such that when folded over and joined to each other with a central lateral inseam, and joined to the palm portion by a cross inseam, the location of the finger seam to the back of the fingernail is achieved.

An appropriate use of the present invention is in the manufactures of hunting gloves wherein the forefinger is constructed in the manner described herein. This is the finger that operates the gun trigger which forefinger if covered by a glove which is seam free in the area of contact with the trigger will enhance the performance of the user.

The invention may either be used alone or in combination with the thumb construction disclosed in the inventor's prior patents.

The features and advantages of the invention will be more fully understood from the description of the preferred embodiment and the drawings which follows.

DESCRIPTION OF THE PREFERRED EMBODIMENTS

Figure 1:
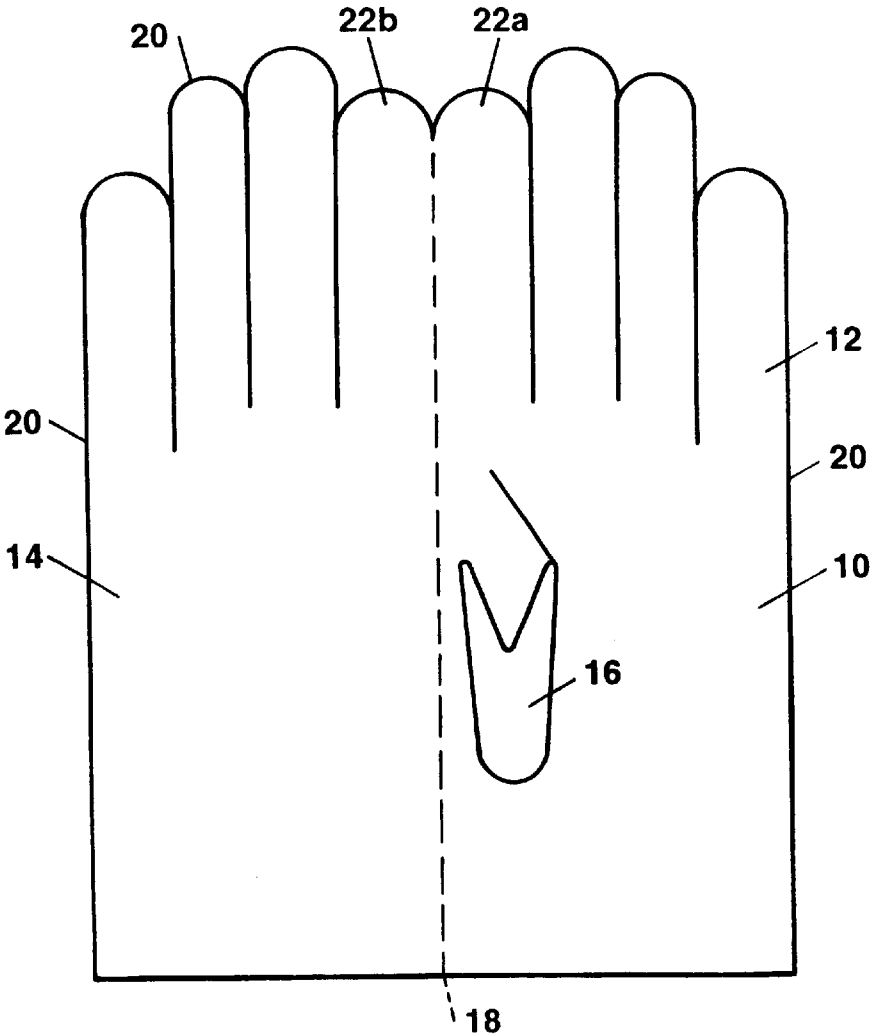
Figure 1 PRIOR ART
FIG. 1 is a plan view of a glove finger pattern of the prior act.

Referring first to FIG. 1, a plan view of the finger portion of a conventional glove pattern is shown. The pattern 10 and the glove material cut from it consists of two identical or symmetrical sides 12 and 14. Side 14 has cut-out 16 known as a thumb gouge to which is attached either a conventional thumb unit or an asymmetrically patterned unit as is described in the inventors previously identified patents. To fabricate the finished finger portion which includes the palm, sides 12 and 14 are folded over on one another on line 18 and stitched all around the parameter 20 to form the conventional tip seam. The forefinger is formed from sections 22*a* and 22*b* and the other fingers as will be obvious.

Figure 2:
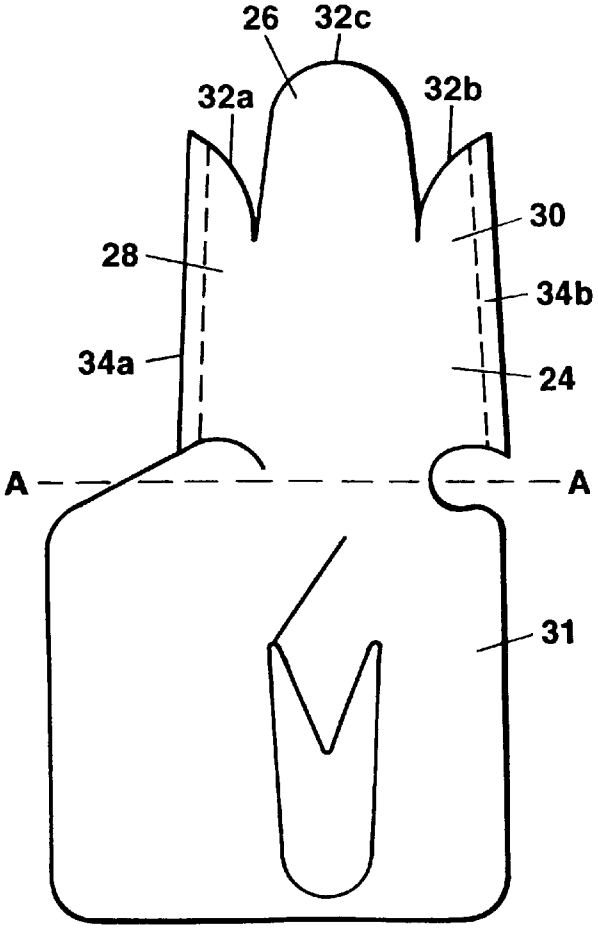
FIG. 2 is a plan view of a glove finger pattern of the preferred embodiment of the invention.
Figure 3:
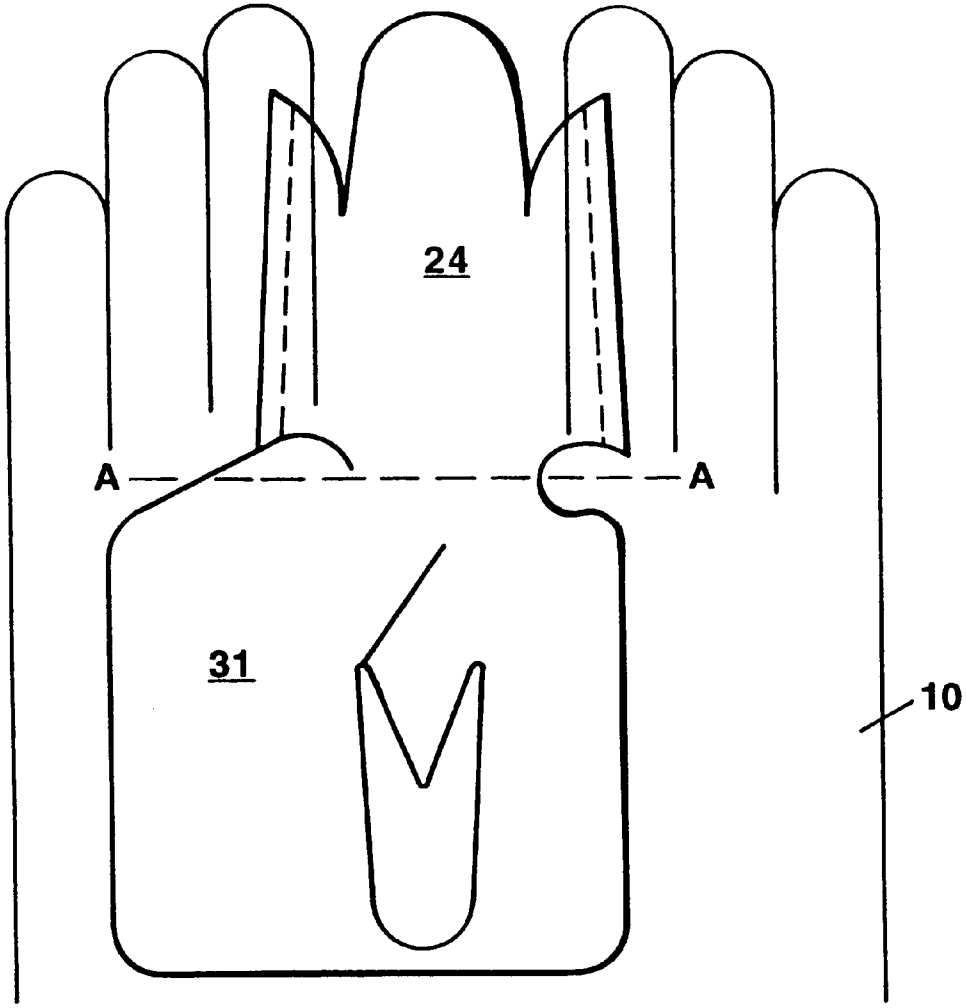
FIG. 3 is a plan view of the pattern of FIG. 2 incorporated with a portion of the pattern of FIG. 1.

Referring next to FIG. 2, a pattern 24 of the preferred embodiment is shown which as will be seen in FIG. 3 is, in the practice of the invention, substituted for a portion of the conventional prior art pattern of FIG. 1.

Pattern 24 consists of a central palm portion 26 which is of sufficient size to wrap around and form the sides of the finger. Two opposed wing portions 28 and 30 are attached to and integral with central portion 26 and are of sufficient size to each form one half the back of the finger. FIG. 3 illustrates the integration of the appropriate portion of the conventional pattern 10 of FIG. 1 and pattern 24 of the invention. As is shown an optional portion 31 below line A—A comprising a substantial area of the palm of the glove may be added to finger pattern 24.

Figure 5:
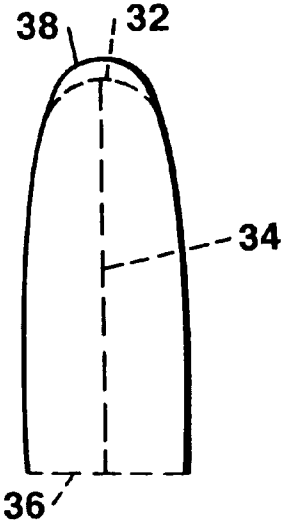
FIG. 5 is a rear view of the of the completed finger of the pattern of FIG. 2.
Figure 4:
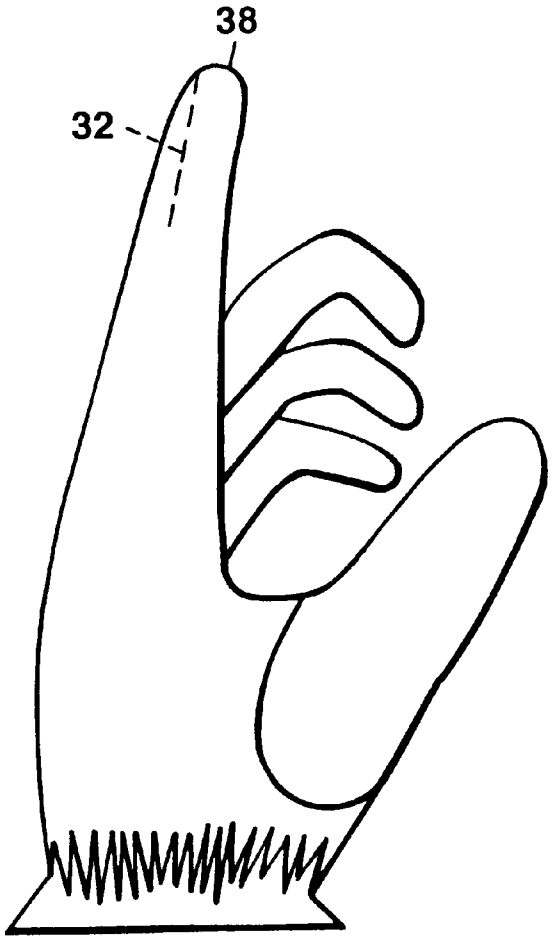
FIG. 4 is a side view of the completed finger of the pattern of FIG. 2.

Two separate inseams are used to secure the above portions into a finished finger. One is a cross inseam formed by attaching edges 32*a*, 32*b* and 32*c*. The other is a lateral inseam formed by attaching edges 34*a* and 34*b*. A portion of the bottom of the pattern, 36*a* and 36*b* is also sewn as indicated. The resulting construction is shown in FIG. 4 and FIG. 5. As will be seen, inseam 32 is above the apex 38 of the thumb on the hand of the user and rests on the back of the fingernail rather than the tip as has heretofore been explained.

Figure 6:
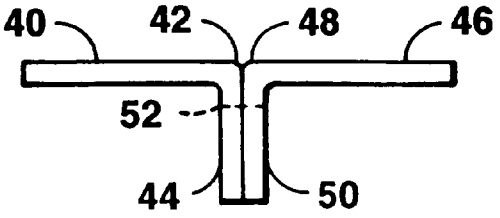
FIG. 6 is a cross sectional view of the form of the seam utilized in the preferred embodiment of the invention.

FIG. 6 illustrates in cross section the form of the seam known as an inseam which is preferably and advantageously used in the construction if the aforementioned glove. A first material portion 40 is folded over at 42 to form an inner portion 44 and the second material portion 46 to be joined to the first is folded over at 48 to form inner portion 50. Inner portions 44 and 50 are then stitched by a thread 52 to join material portions 40 and 46 on the inside of the glove.

As variations in the above described construction might be made in order to obtain the same resulting configuration, the invention is hereby defined by the following claims.

What is claimed is:

1. In a sport glove comprised in part of a flat pattern of a selected material formed into a finished finger covering unit having a tip, a palm portion, and a back portion by joining edges of the pattern by a non-overlapping inseam, the improvement which comprises locating said inseam above the tip of said unit and on said back portion of said unit, said inseam arranged to lie within that part of said back portion which when in use will cover the fingernail of the wearer.

2. The finger unit of claim 1 wherein said non-overlapping inseam follows the curvature of the tip of the finger of the wearer.

3. The unit of finger of claim 2 wherein said finger comprises a forefinger.

4. A glove including a finger unit compromised of:

A. a pattern compromised of:

1. A central palm portion arranged to cover the palm and two sides of a finger when said pattern is sewn into a completed unit; and 2. Two adjacent wing portions attached to each side of said palm portion each arranged to cover about one half of the back of said finger when said pattern is sewn into a completed unit, said unit formed by joining the side edges of said wing portions with a lateral seam and the top edges of said palm portion and said wing portions with a cross seam, said cross seam arranged to lie within that part of said back which when in use will cover the fingernail of the wearer.

5. The finger unit of claim 4 wherein said cross seam follows the curvature of the tip of said finger.

6. The unit of claim 5 wherein said finger comprises a forefinger.

* * * * *